US007406748B2

(12) United States Patent
Baer

(10) Patent No.: US 7,406,748 B2
(45) Date of Patent: Aug. 5, 2008

(54) HINGE WITH STIFFENED LEAF

(76) Inventor: Austin R. Baer, 24416 Highway 550, Ridgway, CO (US) 81432

( * ) Notice: Subject to any disclaimer, the term of this patent is extended or adjusted under 35 U.S.C. 154(b) by 133 days.

(21) Appl. No.: 10/561,888

(22) PCT Filed: Jun. 30, 2004

(86) PCT No.: PCT/US2004/020870

§ 371 (c)(1),
(2), (4) Date: Dec. 20, 2005

(87) PCT Pub. No.: WO2005/005758

PCT Pub. Date: Jan. 20, 2005

(65) Prior Publication Data

US 2006/0150369 A1 Jul. 13, 2006

Related U.S. Application Data

(60) Provisional application No. 60/483,853, filed on Jun. 30, 2003.

(51) Int. Cl.
*E05D 7/00* (2006.01)

(52) U.S. Cl. ..... 16/354; 16/382; 16/387

(58) Field of Classification Search ..... 16/354, 16/387, 382, 388–392; D8/323–329; 29/11
See application file for complete search history.

(56) References Cited

U.S. PATENT DOCUMENTS

| | | | |
|---|---|---|---|
| 1,036,734 | A | 8/1912 | Sessions |
| 1,097,458 | A | 5/1914 | McKinney |
| 1,623,572 | A | 4/1927 | Berger |
| 3,402,422 | A | 9/1968 | Baer |
| 4,825,508 | A | 5/1989 | Post, Jr. |
| 4,873,744 | A | 10/1989 | Johnson, Jr. |
| 4,999,879 | A | 3/1991 | Baer |
| 5,778,491 | A | 7/1998 | Baer |
| 5,991,975 | A | 11/1999 | Baer |

*Primary Examiner*—Chuck Y. Mah
(74) *Attorney, Agent, or Firm*—Duane Morris LLP

(57) ABSTRACT

A hinge including a stiffened leaf. The hinge may generally comprise a first longitudinally-extending leaf having a base portion and a mounting portion offset and preferably parallel to the base portion that defines a cavity. The mounting portion may contain at least one hole for attaching the leaf to a hinged object with a fastener. In one embodiment, the hole further includes an annular reinforcement disposed in the cavity proximate to the hole. The hole may be conical in shape and may extend into the reinforcement to receive and support a conically-shaped fastener head. The hinge is suitable for thin leaf construction and continuous full-length hinge applications.

33 Claims, 12 Drawing Sheets

FIG. 14A
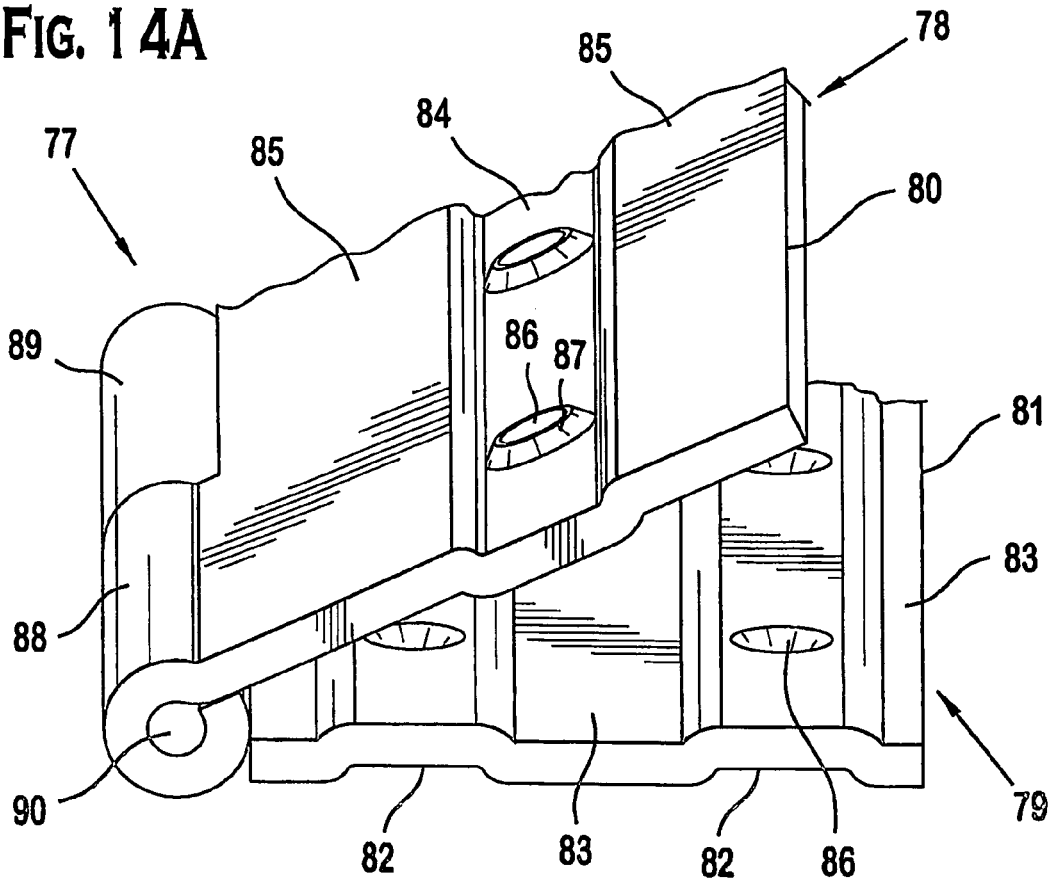
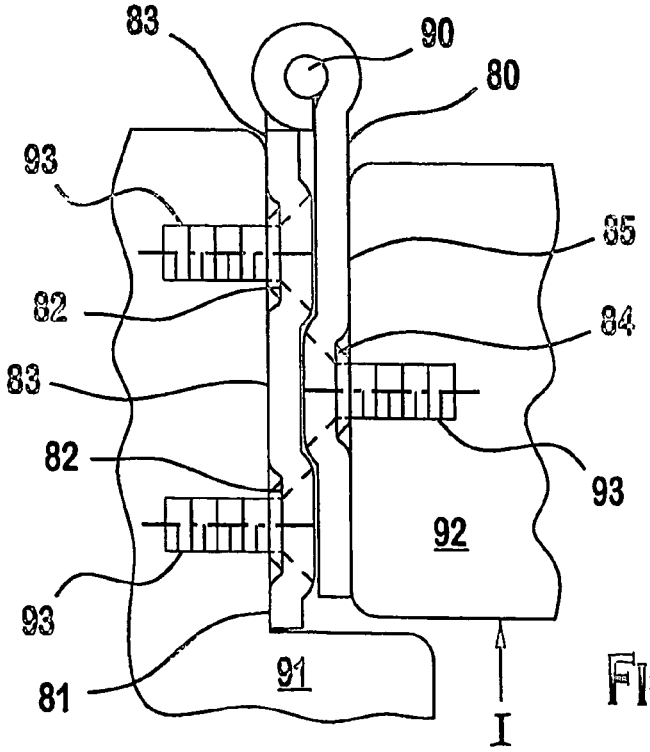
FIG. 14B

HINGE WITH STIFFENED LEAF

CROSS-REFERENCE TO RELATED APPLICATIONS

The present application is a U.S. National Phase Application of International Application PCT/2004/020870 (filed Jun. 30, 2004) which claims the benefit of U.S. Provisional Application No. 60/483,853 (filed Jun. 30, 2003), all of which are herein incorporated by reference in their entirety.

BACKGROUND OF THE INVENTION

The present invention relates to continuous hinges for use with architectural doors and frames. More particularly the invention relates to forming hinge leaves for continuous hinges to facilitate and improve their secure attachment with threaded fasteners by stiffening the metal leaves of such hinges through embossing or other means to produce a unique surface structure. The invention further relates to a hinge leaf fastener hole configuration and structure, and methods for forming the same, to optimize the choice of fasteners and improve the strength of such holes. These features will facilitate interchangeability of the invention with other continuous hinges, in both new and hinge replacement applications by providing a hinge that may be made to fit industry standard door opening clearance gaps. Other advantages of the invention include providing the means to make hinges that are more fire-resistant, less prone to shipping damage, and visually more appealing.

Hinges that are continuous, i.e., hinges that attach a door to its frame or to another door for a substantial part of the length of the joined portions, are well known. Such hinges take various forms, including hinges which are formed from sheet metal by stamping and curling "knuckles", or essentially cylindrical receptacles, along the length of a strip which will accept a longitudinal pin, wire or rod. The knuckles are separated by spaces of generally equal length so that the opposing knuckles of a second hinge member may be interposed between the knuckles of the first hinge member and joined by the pin, wire or rod. Such hinges are commonly known as "piano" hinges, and are used, in addition to pivoting the covers for piano keyboards, for building athletic lockers, furniture, equipment enclosures and for building architectural doors and frames, or wherever a secure hinging system is required. U.S. Pat. No. 5,991,975, which is incorporated herein by reference, describes a hinge of this type, which has been improved by a variety of means to mechanically articulate a covering member to enhance its appearance as well as to improve its protection from environmental deterioration and other hazards.

Another form of continuous hinge, described in U.S. Pat. No. 3,402,422, which is incorporated herein by reference, teaches a continuous hinge with two hinge members rotatably mounted about the edges of a C-shaped, elongated clamp that defines an internal channel. Gear segments at the edges of the hinge members are meshed with each other to pivotably connect the hinge members. One or more thrust bearings disposed in recesses of both hinge members prevent relative movement of the hinge members along their axes of rotation. The bearings occupy most of the cross-sectional spaces within the clamp and have bearing surfaces on their ends that are generally parallel to, abut, and support the recess end surfaces of the hinge member recesses. Another configuration of a continuous hinge is taught in U.S. Pat. No. 4,999,879, which is incorporated herein by reference, discloses hinge members with gear segments meshed with the clamp instead of, or in addition to, being meshed with each other.

The continuous hinges described above are characterized by hinge leaf members that are substantially flat so as to lie flush with the hinged objects (e.g., door, door frame and jamb, etc.) to which they are mounted. FIGS. 1A-C depict such a typical flat hinge leaf configuration. These flat hinge leaves, however, may lack sufficient strength and are prone to warpage and damage when made of relatively thin material, such as sheet steel. Due to the thinness of the material, they also may not be usable with standard fasteners used in the door hinge industry, such as No. 12 flat top, conical head self-tapping screws (either full or undercut head designs), and require special fasteners or modification of standard fastener offerings. The dimensions for such standard No. 12 screws are established per American Society of Mechanical Engineers National Standard ASME B18.6.4-1998, entitled "Thread Forming and Thread Cutting Tapping Screws and Metallic Drive Screws (Inch Series)," issued Dec. 31, 1999.

Some of the continuous hinges of the kinds described above have gained wide acceptance in the building construction industry. However, because of the variety of materials and processes used in their fabrication, together with their widespread availability from different sources, little attention has been given to interchangeability from one manufacturer's offerings to another, or between different choices of hinge leaf material such as aluminum or steel. Because of its typically greater strength, steel leaves can be made thinner than their aluminum counterparts that must be made thicker to achieve comparable strength. This is particularly important in industrial and commercial door installations with tall (sometimes 9 feet or more high) and heavy doors where strong hinges are required. Because extruded aluminum hinges are typically less expensive, they have become somewhat of the industry standard for continuous hinges, except where building codes require fire resistant door installations (as discussed below) or other considerations require selection of thinner steel hinges. As shown in FIG. 1C, a 5/16 inch gap has virtually become the industry standard door-to-jamb clearance gap for aluminum hinges. This gap is filled by aluminum hinge leaves (two) which are typically 1/8 inch thick each and a 1/16 inch clearance between the leaves when closed. As is apparent, if a steel hinge having thinner leaves is desired to be substituted for the aluminum hinge, there is insufficient leaf thickness to fill the standard 5/16 inch gap, requiring costly and inconvenient door and/or frame modifications. Even though the thinner leaves could be set wider apart by forming the knuckles to create a wider separation between them when the leaves are parallel, this would leave a large gap between them, which is undesirable because it would allow excessive air infiltration as well as permit warping and large distortions of the leaves under conditions of building fires in which steel hinges are principally intended. Accordingly, there is a need for a hinge with thinner leaves that can accommodate the standard 5/16 inch clearance gap, thereby allowing interchangeability between steel and aluminum hinges.

Differences in resistance to the effects of fire and other operational hazards between continuous hinges that may be manufactured of different materials has made it difficult to exchange or replace hinges with others more suitable for a particular location in a building or for a different operating requirement. Hinges made of steel are more fire resistant, but hinges made of aluminum, while less so, are cheaper but have thicker leaves. Frequently, misinterpretation of complex building codes by architects and designers results in the installation of new hinges made of the wrong material (e.g., aluminum), or changes in building codes require the replacement of existing aluminum hinges with steel hinges that meet the more stringent fire rating criteria so that the lunge installation can be brought up to code.

The consequences of upfront errors by architects and designers that may occur in the specification of a particular hinge for a particular door assembly in new building construction or retrofit applications may be also be severe. Unlike separate hinges, known as "butt" hinges or mortise hinges that can be inlaid into the jamb or rabbet of a door frame and into the hinged edge of a door, continuous hinges are generally applied to the surfaces of the jamb and door edge. This requires that a space or clearance gap of sufficient width is provided between the door and its frame to accept the thickness of the two hinge members that form the continuous hinge assembly. As discussed above, if the continuous hinge is manufactured from aluminum extrusions, for example, the required leaf thickness may be far greater than is needed if the hinge members are fabricated from sheet steel in order to achieve the proper support for doors of equal weight and service requirements. This has often meant that the clearance allowance for such doors and frames must be determined by the architect or builder only after the selection of the continuous hinge has been made. Frequently, the hinge specification must be changed during the construction sequence, because different hinge materials may be required for compliance with fire or other complex regulations, or must be changed during the useful life of the building because various building codes may be changed, or because the building may be used for subsequent, unanticipated purposes which require such changes. As can be appreciated, continuous hinges which vary in thickness simply because of their materials of construction can create costly delays in the construction sequence and costly replacements of improperly sized frames and doors when errors in specification occur.

The present invention advantageously addresses these hinge replacement or substitution issues for the first time with a thin leaf hinge design that can be made to fit into substantially the same standard 5/16 inch clearance gap that is allowed for cheaper aluminum hinges. Current thin leaf hinges that are commercially available offer no such comparable interchangeability, resulting in the costly substitution of a new door and/or frame to meet the clearance requirements of alternate hinging systems.

Another difficulty arises in the fastening of continuous hinges to their doors and frames. To avoid making the requisite door-to-frame clearance excessive, countersunk flat head screws are used to minimize the projection of the screw heads above the surfaces of the hinge leaves. When hinges are manufactured of thick plates, as is done with short, mortised hinges (commonly known as "butt" hinges) or with thicker aluminum continuous hinge leaves, this is normally not a problem. The material is generally thick enough to provide a conical or other shaped recess that is sufficiently deep to accommodate the screw head within the thickness of the material. Accordingly, standard flat full conical head screws (see FIG. 2A) may sometimes be used. If the leaf material is not sufficiently thick enough to allow a full conical screw head form to be machined or embossed into the hinge leaf, standard flat undercut conical head screws (see FIG. 2B) can be used. Such screws have heads which take the form of an inverted trapezoid in cross-section (in contrast to an inverted triangular cross-section which meets the body of the screw). Undercut flat head screws, while useful for reducing the required depth of the countersink in hinges and similar hardware items, restrict the strength of the attachment, particularly if the head thickness is reduced too much. It will be appreciated that the proportion of the screw head diameter and thickness to the screw thread size must be maintained within certain limits if the screw fastener is to be optimized for its holding capability. If the head of the screw is too large in diameter in relation to its thickness and the body size of the screw, it could be so weak as to break in normal service, and it might be too thin to accept standard screwdriver tips commonly used with conventional screw driving tools that cooperate with the recess formed in the screw head.

If the screw heads are made the slightest bit thicker than the gauge of the hinge leaves, the screw head will "bottom" against the door or frame material before the leaf is forced and held tight against its supporting surface, resulting in a loose and weak hinge installation. Accordingly, the screw head thickness cannot exceed the thickness of the hinge member material, or the screw will not hold the hinge member tightly to the door or the frame. Because aluminum continuous hinge leaves are generally thicker than their steel counterparts, screw fasteners can be more robust in their design and construction, often allowing the use of standard flat conical head screws (see FIG. 2A) or standard undercut flat conical head screws (see FIG. 2B). With steel hinges made of relatively thin-gauge fabricated sheet metal, however, these standard fastener offerings are often unsuitable having screw heads that exceed the thickness of the hinge leaf material by an unacceptable tolerance. Thus screw heads must be severely undercut for use with the thin-gauge steel hinges, thereby weakening them. The alternative to disproportionately thin-headed screws, with large heads that can break or often pull through the screw holes in the hinge members, is to use smaller screws with proportionately smaller heads. However, this sacrifices shear strength and holding power, because unlike mortise or butt hinges which rely on the door and frame cutouts for door support, doors hung with continuous hinges must rely primarily on the strength of the screws alone to support the weight of the door. Clearly, strong screws that are properly designed with sufficiently deep and well-formed holes to accept standard full head or standard undercut head fasteners present a better, more cost-effective solution than increasing the strength of the connections by adding a larger numbers of inadequate, severely undercut fasteners to the hinge leaf installation. Accordingly, there is a need for a thin leaf hinge that permits using standard fasteners with their inherent strength advantages over severely undercut or undersized fasteners.

As this invention advantageously provides with thinner metal leaves that are formed with a raised mounting portion to accept the screws, the foregoing difficulties are avoided. Not only can a thicker screw be used, but the countersunk hole can be formed with a reinforcement below the leaf that provides conical walls that are actually deeper than the gauge of the leaf material alone. Thus instead of a screw hole recess which has countersunk walls that are no deeper than the metal thickness, which limits the screw type to either small screws or screws with extremely undercut thin heads, either of which can easily be pulled through the screw hole opening, a more robust screw head design can be employed that will take full advantage of a more fully formed countersink and standard fasteners.

The handling and shipping of continuous hinges presents yet another problem. Hinges fabricated of steel sheet metal in long lengths are easily bowed, dented, and bent during their shipment, handling at the jobsite, or during installation. Yet another disadvantage of sheet metal hinges is difficulty in maintaining proper appearance after installation, because the screw tension at widely separated screw locations along the length of each hinge member distorts the material, producing highly visible waviness and unsightly reflections in the finished installation. This is particularly unacceptable for commercial installations. Thus there is a need for a thin leaf hinge that addresses these leaf distortion problems.

The present invention advantageously addresses these problems by providing a multi-level or -planar hinge leaf having raised mounting portions which act to stiffen the leaves, thereby reducing the actual distortion and masking the remaining distortion produced by the fasteners (especially if the fasteners are applied with non-uniform pressure typical of on-site building construction practices with hand-held tools).

Equally important is the screw hole forming technique itself. With thin gauge hinge leaf materials, the screw holes can be punched, but a secondary operation is often required to machine a bevel around the rim of the hole to accept the conical edge of a flat head screw. Otherwise, only those types of screws which have a head that projects above the surface of the hinge leaf could be employed, making the installation both unsightly and producing a wide gap between the hinges leaves in the closed position. In other manufacturing techniques, a slightly beveled rim can be stamped around the edge of each hole, but the depth and conformity to the screw head design is limited by the extremely high forces required in "coining" these edges and the durability of the forming punches to withstand the pressures needed to produce metal flow within the material thickness of the leaves. Moreover, these limits of press-formed conical shapes require that the initial hole be initially stamped to a much larger diameter than the body or shank of the screw would normally otherwise require, because the limited ability of the metal to flow into a conical shape limits the bevel to the outer edges of the hole. Flat head countersunk screws contact such screw holes around their outer edges only, creating hinge leaf screw pull-through problems when the leaf is being fastened to a hinged object and screw breakage because of the leverage effect between the outer edges of severely undercut thin-headed screws and their sharp edged (stress concentration notch) transition to the screw body. Thus there is a need for an improved method of forming fastener holes in hinge leaves.

The leaf design of the present invention advantageously allows fastener holes to be punched through thin gauge leaves, and then formed into a conical recess which can be much deeper than the gauge of the material by creating a reinforcement below the screw hole on the underside of the leaf. This forming process can be done in one or more steps as appropriate, and utilizes embossing, or deformation, as opposed to machining or coining. The depth of such countersinks allows the use of standard screws with thicker, stronger heads. In addition, the formation of holes of this kind inherently work-hardens the hinge leaf in the area of the deformation, producing a ring of toughened material to help prevent screw pull-through.

Another advantage of the raised or embossed hinge leaf design is the formation of a recess or cavity on the underside of each leaf (between the leaf and hinged object) which can be filled with intumescent fire-resistant materials. These materials, in the presence of extreme heat, such as occurs in building fires, swell to many times their original thickness. They can be applied in the form of a coating or paste within the recess of the ribbing or embossing without any additional space required for application. In the presence of fire, each leaf will be pressed outward from the surface of the door or frame to which it is fastened, which can create an effective fire barrier by wedging the door tightly against the jamb on the opposing side of the door. Because widely accepted fire testing procedures (see National Fire Protection Association Code 80 Testing) do not require doors to operate at the conclusion of a fire test, such wedging action takes full advantage of the strength of each component of the door and frame system by forcing the full length of each leaf against the other, which helps to form a fire seal as well as a mechanical wedge.

BRIEF SUMMARY OF THE INVENTION

The present invention is generally directed to a longitudinally extending continuous hinge comprising specially formed leaves having a unique multi-level or -planar surface structure including a combination of raised and base portions. This offers the advantage of structurally stiffening the leaf allowing the use of thinner, stronger hinge leaf materials with improved strength and rigidity. Such thinner materials may preferably include steel which has superior fire resistance than aluminum which is commonly used for continuous hinges. The raised leaf portions further provide a recess or cavity on the underside of the leaves, and between the leaves and hinged objects when mounted thereto, to allow the creation of fuller depth, conically recessed screw holes than heretofore available. These cavities can also be filled with intumescent fire-resistant materials to improve the fire rating of the hinge. The present invention further provides interchangeability with existing industry standard continuous hinge door mounting clearances allowing hinge leaf materials to be easily switched without altering the door and frame. The present invention also allows the use of standard stronger fasteners without sacrificing attachment strength.

A hinge formed according to principles of the present invention comprises a first hinge member and a second hinge member pivotably connected together. In one embodiment, the hinge members each comprise knuckles and a leaf connected thereto to mount the respective hinge members to hinged objects. The knuckles of the first hinge member are interspersed between the knuckles of the second hinge member. A pin may be provided that runs through the knuckles of the first and second hinge members, thereby pivotably connecting the two hinge members.

In another embodiment, the first and second hinge members each have leaves with a longitudinally extending edge. The leaves are pivotably connected together along at least part of the longitudinally extending leaf edges by a longitudinally extending clamp. Preferably, the longitudinally extending leaf edges each have a gear segment which mesh together and are held in operable engagement with each other by the clamp. Also preferably, the clamp has two longitudinally extending edges that are inwardly inclined to engage the longitudinally extending edges of the hinge leaves.

In one embodiment, the leaves of at least one hinge member are formed with a raised surface structure that is multi-leveled or -planar. The leaf may comprise at least a first planar level surface and at least a second planar level surface. The first planar level surface may be adjacent the second planar level surface. The first planar level surface is at a first plane and the second planar level surface is at a second plane different than the first plane. In another embodiment, the first planar level surface may further comprise two or more discontiguous sections lying in the same first plane. The second planar level surface may further comprise two or more discontiguous portions lying in the same second plane. In one embodiment, the first planar level surface preferably abuts against or contacts a hinged object when the leaf member is mounted to the hinged object. The second planar level surface preferably does not abut or contact the hinged object directly.

In another embodiment, the leaves of each hinge member have a surface structure comprising a substantially flat or planar base portion and a raised or elevated mounting portion.

At least a part of the raised mounting portion defines a substantially flat or planar surface that is displaced apart from, but generally parallel to and offset from the base portion. The raised portion comprises at least part of the surface area of the respective leaf of which it is part. In one embodiment, the raised portion is flanked on either side by narrow base portion sections. In another embodiment, the raised portion extends longitudinally along substantially the entire length of each leaf and defines longitudinally extending raised ribs or rails.

A hinge formed according to principles of the present invention further comprises each leaf having a plurality of fastener holes for mounting the hinge members to a hinged object. The holes preferably have a conical cross-sectional shape to allow the use of flat head conical mounting screws which are standard in the door hinge industry. Preferably, the fastener holes are located in the raised leaf portions described above; however, not all the holes need necessarily located in the raised portion. The holes in the raised portions preferably have a reinforcement on the underside of each leaf associated with each hole. The reinforcements, which may be annular or ring-like in configuration, preferably extend in a perpendicular direction outwards from the hole on the underside of the leaf. At least a portion of the reinforcement preferably defines a substantially flattened top for securely abutting a hinged object when the hinge member is mounted to the hinged object. Preferably, the hole reinforcements and the base portion or first planar level surface contact the hinged object when the hinge member is mounted thereto. The hole reinforcements add strength to the underside of the leaf and help prevent the fasteners from pulling through the leaf material when the leaf is mounted to a hinged object. The hole reinforcements also provides additional depth to the fastener hole allowing the use of standard fasteners to mount the leaf to a hinged object.

In a further embodiment, a plurality of raised portions or second planar level surfaces may be provided for each hinge member leaf. Preferably, the raised portion(s) or second planar level surface(s) are provided in at least the leaf areas containing fastener openings. The number, location, shapes, and dimensions of the raised portions or second planar level surfaces are a matter of design choice and not limited to those shown in the preferred embodiments disclosed herein.

A method of securing a hinge leaf to an object using fasteners is provided. In one embodiment, the method includes: placing a first hinge leaf against an object, the first leaf having a base portion with a substantially flat surface and a mounting portion having a surface offset and parallel to the base portion; the mounting portion further defining a cavity between the mounting portion and the object; inserting at least one conical flat head fastener through at least one hole defined by the mounting portion, the hole circumscribed by an annular reinforcement disposed in the cavity proximate to the hole, the mounting portion and reinforcement further defining a conical surface around the periphery of the hole; embedding the fastener in the object; and supporting a majority of a side of the conical head of the fastener against the conical surface. In another embodiment, the fastener is a standard No. 12 undercut conical flat head screw dimensioned per American Society of Mechanical Engineers National Standard ASME B18.6.4-1998, entitled "Thread Forming and Thread Cutting Tapping Screws and Metallic Drive Screws (Inch Series)" issued Dec. 31, 1999.

In yet another method of installing a hinge leaf to a hinged object, the method includes: forming a cavity between a hinge leaf and a hinged object; locating a conical fastener head having a depth in the cavity and hinge leaf, and supporting a majority of the depth of the conical fastener head in the leaf and cavity. In one embodiment, the conical fastener head has a depth of a standard No. 12 undercut conical flat head screw dimensioned per American Society of Mechanical Engineers National Standard ASME B18.6.4-1998, entitled "Thread Forming and Thread Cutting Tapping Screws and Metallic Drive Screws (Inch Series)" issued Dec. 31, 1999.

In one embodiment, a preferred method of making a hinge leaf is also provided. The method includes: forming a cavity in a hinge leaf having a thickness and an underside; forming at least one conical fastener hole through the leaf that communicates with the cavity; and reinforcing the underside of the leaf in the cavity around the hole. In another embodiment, the step of reinforcing the underside of the leaf includes locating at least one reinforcement having a thickness in the cavity proximate to the hole so that the combined leaf and reinforcement have a thickness greater than the thickness of the leaf alone.

In another embodiment, a method of fabricating a hinge leaf with reinforced holes capable of accepting a conical flat head fastener is provided. The method includes: forming a raised portion in the leaf having an underside to define a cavity therebelow; forming a hole with conical sidewalls in the raised portion configured to receive a conical head fastener for mounting the leaf to a hinged object; and deforming the raised portion at the hole to form an annular reinforcement on the underside of the raised portion around the hole in the cavity. In one embodiment, the steps of forming the hole and reinforcement are completed in a single machining step. In another embodiment, the hole and reinforcement are formed by embossing. In yet another embodiment, the step of forming the reinforcement further comprises forcing the raised portion into a die button placed on the underside of the raised portion. In one embodiment, the method further comprises the step of flattening a top of the reinforcement. In yet another embodiment, the step of forming the hole further comprises forming a conical sidewall on the hole.

In another embodiment, a method of malting a hinge leaf includes: forming a cavity in a hinge leaf having a thickness; forming at least one conical fastener hole in the leaf communicating with the cavity; and locating at least one reinforcement having a thickness in the cavity proximate to the hole so that the leaf and reinforcement have a combined total thickness at least about the same as a height of a head of a standard No. 12 undercut conical flat head screw dimensioned per American Society of Mechanical Engineers National Standard ASME B18.6.4-1998, entitled "Thread Forming and Thread Cutting Tapping Screws and Metallic Drive Screws (Inch Series)" issued Dec. 31, 1999.

The present invention and preferred embodiments will be further described in detail below with specific reference to the drawings provided herewith.

BRIEF DESCRIPTION OF THE DRAWINGS

The features and advantages of the present invention will become more readily apparent from the following detailed description of the invention in which like elements are labeled similarly and in which:

FIG. 14A is a perspective view of a continuous hinge having one embodiment of a hinge leaf according to the principles of the present invention in which the hinge leaves have an interlocking raised pattern; and FIG. 14B is a cross-sectional view of the continuous hinge of FIG. 14A in which the hinge is installed on hinged objects.

DETAILED DESCRIPTION OF THE PREFERRED EMBODIMENTS

It should be recognized that while the present invention is described and illustrated with reference to particular preferred embodiments, the scope of the invention is not intended to be limited to such embodiments. Furthermore, the description of the invention the follows, and any references to orientation, configuration, direction, size, or materials, is intended primarily for convenience and does not limit the scope of the present invention.

Figure 8:
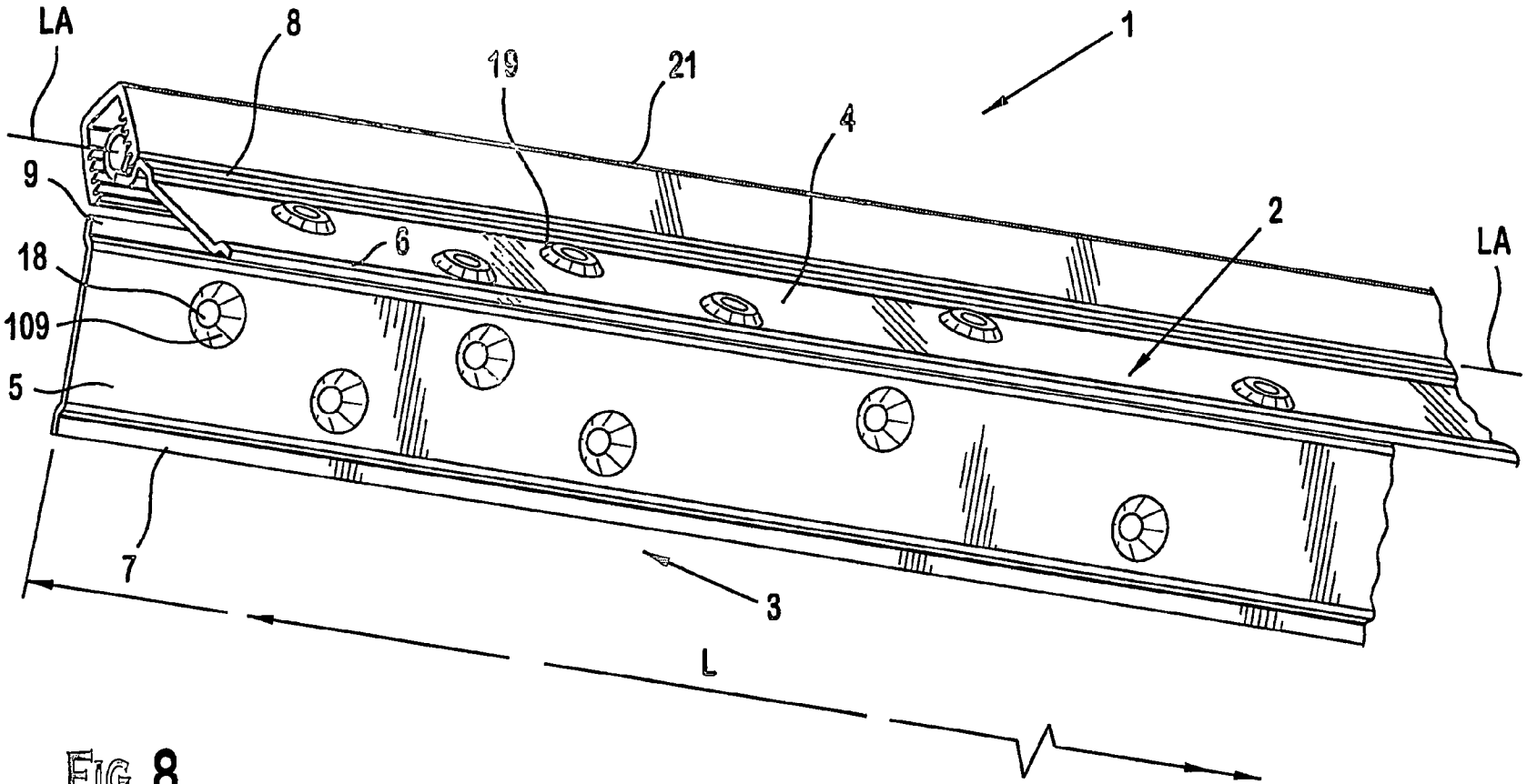
FIG. 8 is a perspective side view of a partial length of a continuous hinge having one embodiment of a hinge leaf according to the principles of the present invention.

The longitudinal direction is herein defined as extending in a direction generally parallel to the longitudinal axis LA along the length of the hinge 1, as shown in FIG. 8. The transverse direction is defined herein as extending in a direction generally perpendicular to the longitudinal axis LA, along the transverse axis TA as shown in FIG. 4C.

Figure 4A:
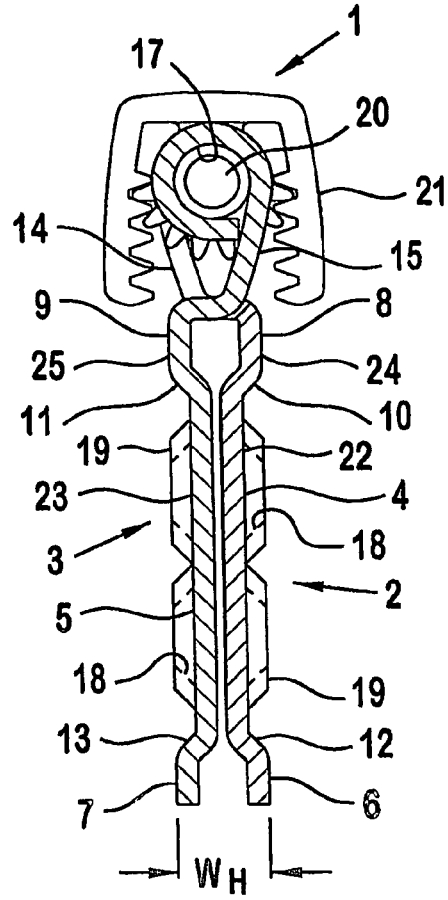
FIG. 4A is a cross-sectional view of a continuous hinge having one embodiment of a hinge leaf according to the principles of the present invention in which the hinge is in a closed position.
Figure 4B:
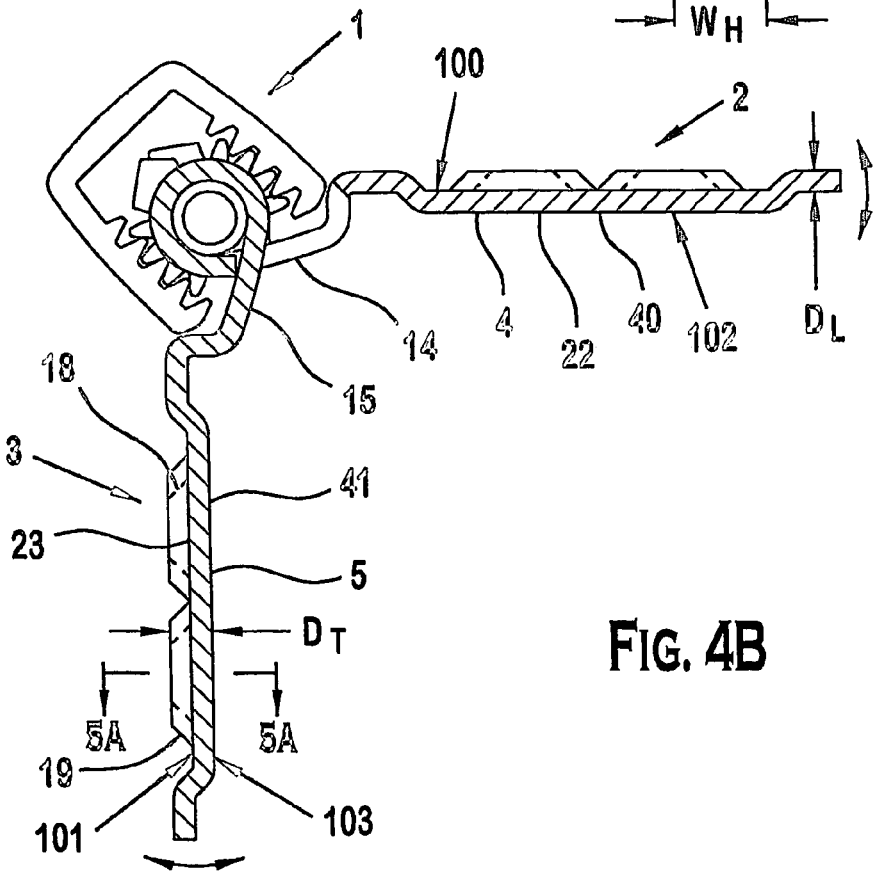
FIG. 4B is a cross-sectional view the continuous hinge of FIG. 4A in which the hinge is in an intermediate position between closed and open.
Figures 4C, 6:
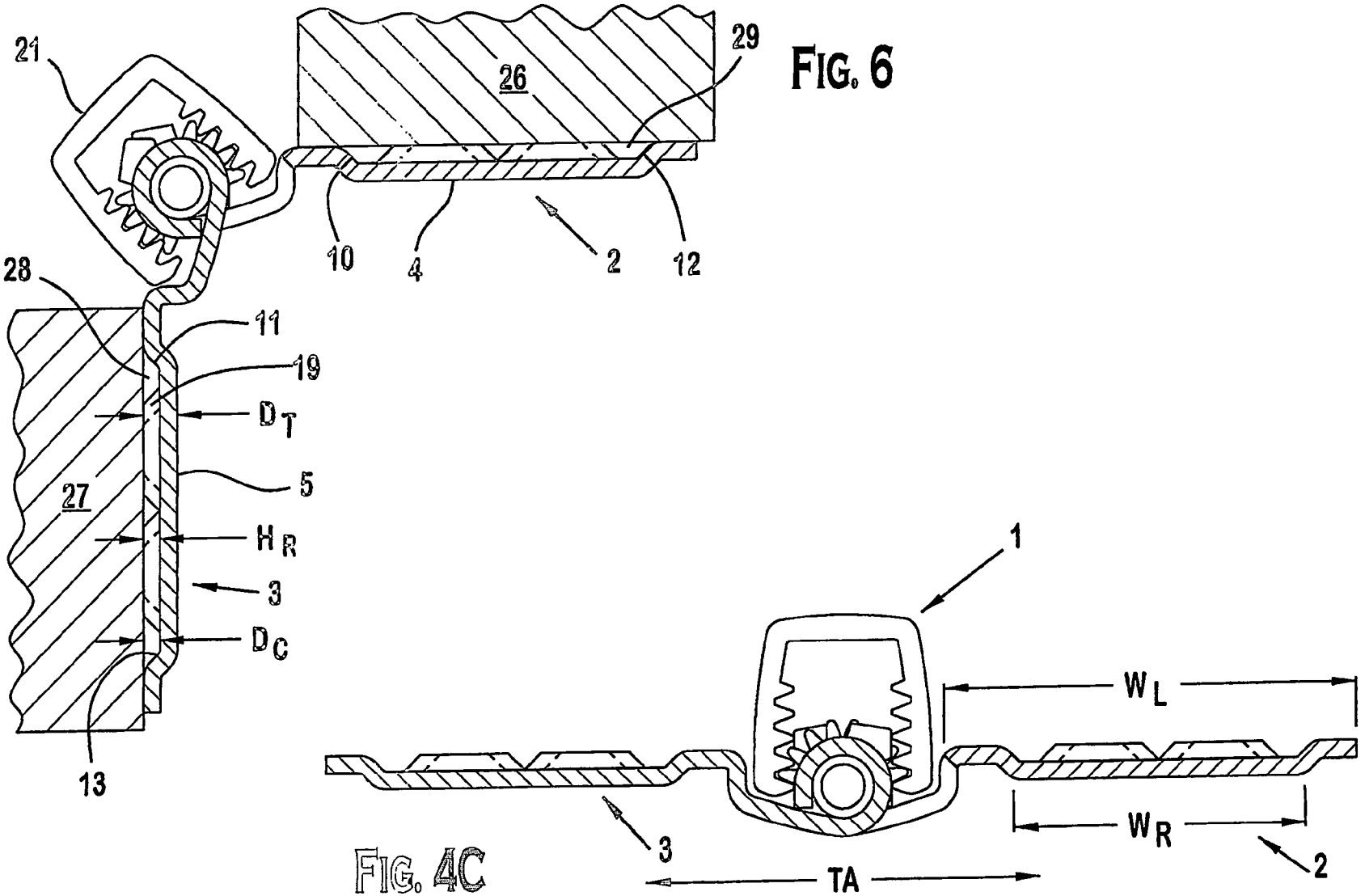
FIG. 4C is a cross-sectional view of the continuous hinge of FIG. 4A in which the hinge is in an open position.
FIG. 6 is a cross-sectional view of a continuous hinge having one embodiment of a hinge leaf according to principles of the present invention in which the hinge is installed on hinged objects.

Referring now to FIGS. 4A-C, there is shown an improved continuous hinge 1 according to a preferred embodiment of the invention. These Figures show the hinge 1 in various positions, including a closed position (FIG. 4A), intermediate position (FIG. 4B), and an open position (FIG. 4C).

Hinge 1 comprises at least two hinge members 2, 3, each having knuckles or barrels 14, 15 and leaves 22, 23 connected thereto, respectively. Leaves 22, 23 each have an underside 100, 101 and topside 102, 103, respectively, and a length L (shown in FIG. 8) and a thickness DL (shown in FIG. 4C). Leaves 22, 23 further include longitudinally-extending edges 104, 105, respectively (see FIG. 10). Knuckles 14, 15 each have a longitudinally extending opening 16, 17 (best seen in FIG. 12), respectively, extending through each knuckle. Knuckle openings 16, 17 are configured to receive a pin 20 for pivotably connecting the knuckles 14, 15 of hinge members 2, 3. Accordingly, the knuckle openings 16, 17 are preferably cooperatively designed to form a coaxially-aligned longitudinal passageway when the knuckles are connected for receiving a joining member such as pin 20 therethrough. Preferably, the knuckles 14, 15 of each hinge member 2, 3 are spaced along the length of their respective hinge members with longitudinally extending gaps therebetween (preferably of equal length) to allow the knuckles of the opposing hinge member to be interspersed therebetween for pivotable connection by pin 20.

Figure 1A:
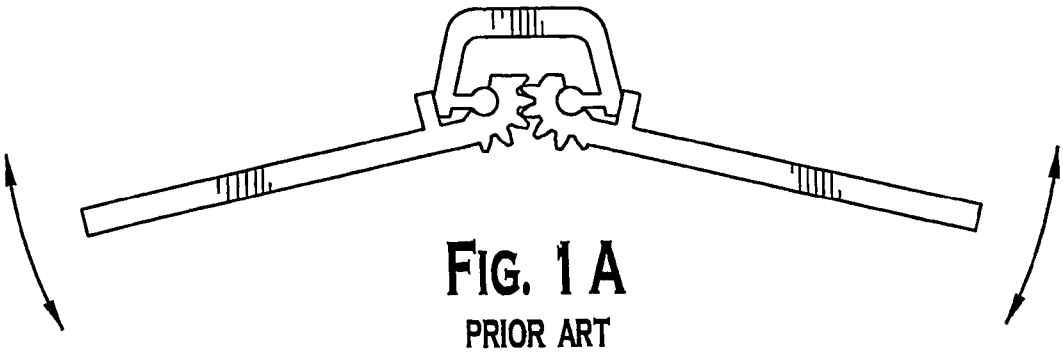
FIG. 1 A PRIOR ART
FIGS. 1A-C depict prior art continuous hinges having flat leaves.
Figure 1B:
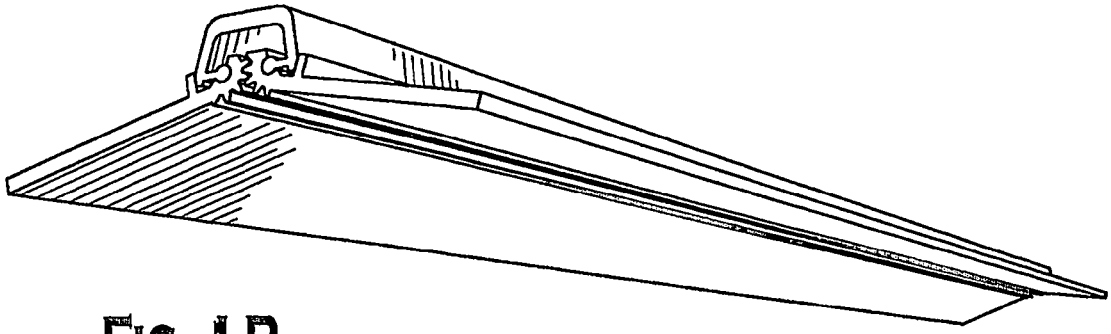
FIG. 1 B PRIOR ART
Figure 1C:
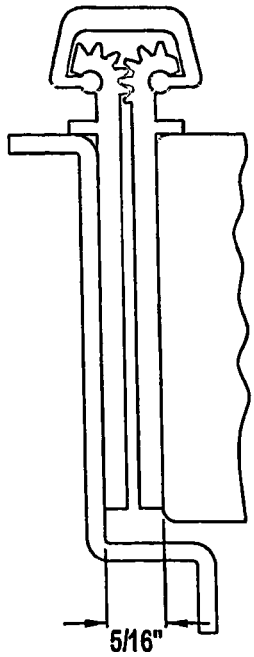
FIG. 1 C PRIOR ART
Figure 2A:
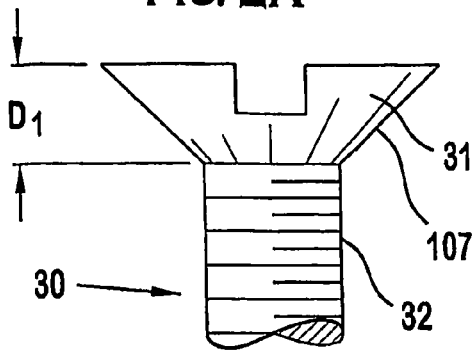
FIG. 2A is side view of a standard full conical head fastener that may be used with the present invention.
Figure 2B:
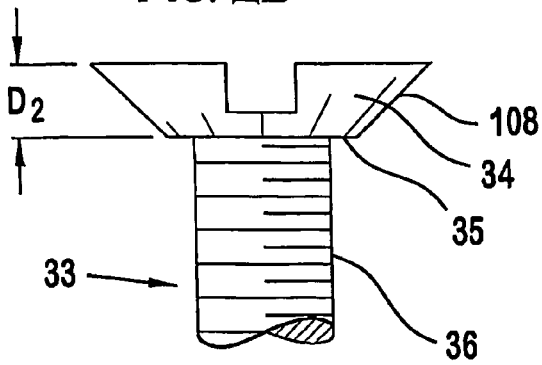
FIG. 2B is a side view of a standard undercut conical head fastener that may be used with the present invention.
Figure 5A:
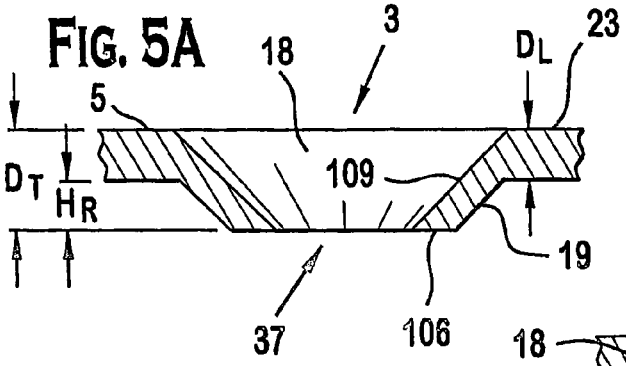
FIG. 5A is a cross-sectional view taken along line 5A-5A in FIG. 4C through a fastener hole.

Preferably, at least one of the leaves 22, 23 has a multi-level or -planar surface structure as shown, and described in detail below. Leaves 22, 23 also have a plurality of fastener holes 18 (see also FIG. 8), with corresponding hole reinforcements 19 disposed on the underside of the leaves, for securing the leaves to hinged objects. FIG. 5A shows a cross-section taken through one of the holes 18 of leaf 23 in FIG. 4B, and more clearly illustrates a preferred hole configuration. Fastener hole 18 preferably has a conical cross-section with sides 109 to preferably form a conical recess to receive and accommodate a flat head screw with a corresponding conical head shape, of the types shown in FIGS. 2A and 2B. FIG. 2A depicts a standard flat head conical screw 30 having a full conical head 31 with side surface 107 and a head depth or thickness $D_1$, and threaded shank 32 for insertion into and engagement of a hinged object. FIG. 2B depicts a standard undercut flat head conical screw 33 having a threaded shank 36, and plain conical head 34 with an undercut 35, side surface 108, and a head depth or thickness $D_2$, as shown.

Head depth $D_2$ of screw 33 for a standard No. 12 undercut conical flat head screw dimensioned per above cited American Society of Mechanical Engineers National Standard ASME B18.6.4-1998, entitled "Tread Forming and Thread Cutting Tapping Screws and Metallic Drive Screws (Inch Series)" issued Dec. 31, 1999, may be from 0.078-0.092 inches. Correspondingly, depth $D_1$ for a standard No. 12 full conical flat head screw dimensioned per the same standard may be a maximum of 0.132 inches.

The conical cross-section of hole 18 preferably extends through the leaf 23 and hole reinforcement 19 below, and is sized to be compatible with the size of the screw head to be used. Preferably, the total combined thickness or depth $D_T$ of the leaf 23 and hole reinforcement 19 is about the same as the thickness or height of the screw head in order to securely hold the leaf 23 to the hinged object 27. Also as shown in the figures, the thickness $D_T$ through combined raised mounting portion 5 of leaf 23 and reinforcement 19 accordingly is preferably greater than the thickness $D_L$ of leaf 23 alone (see, e.g., FIG. 5A). The selection of a standard flat head screw 30 or standard undercut screw 33 will be dictated by the total depth $D_T$ (FIG. 5A) of the hole 18, including the portions through the leaf 23 and reinforcement 19. Preferably, the thickness or depth $D_1$ or $D_2$ of the screw head (within standard manufacturing tolerances in the fastener industry) is about the same as the total depth $D_T$ of hole 18 to allow proper seating of the leaf against the hinged object.

Figure 12:
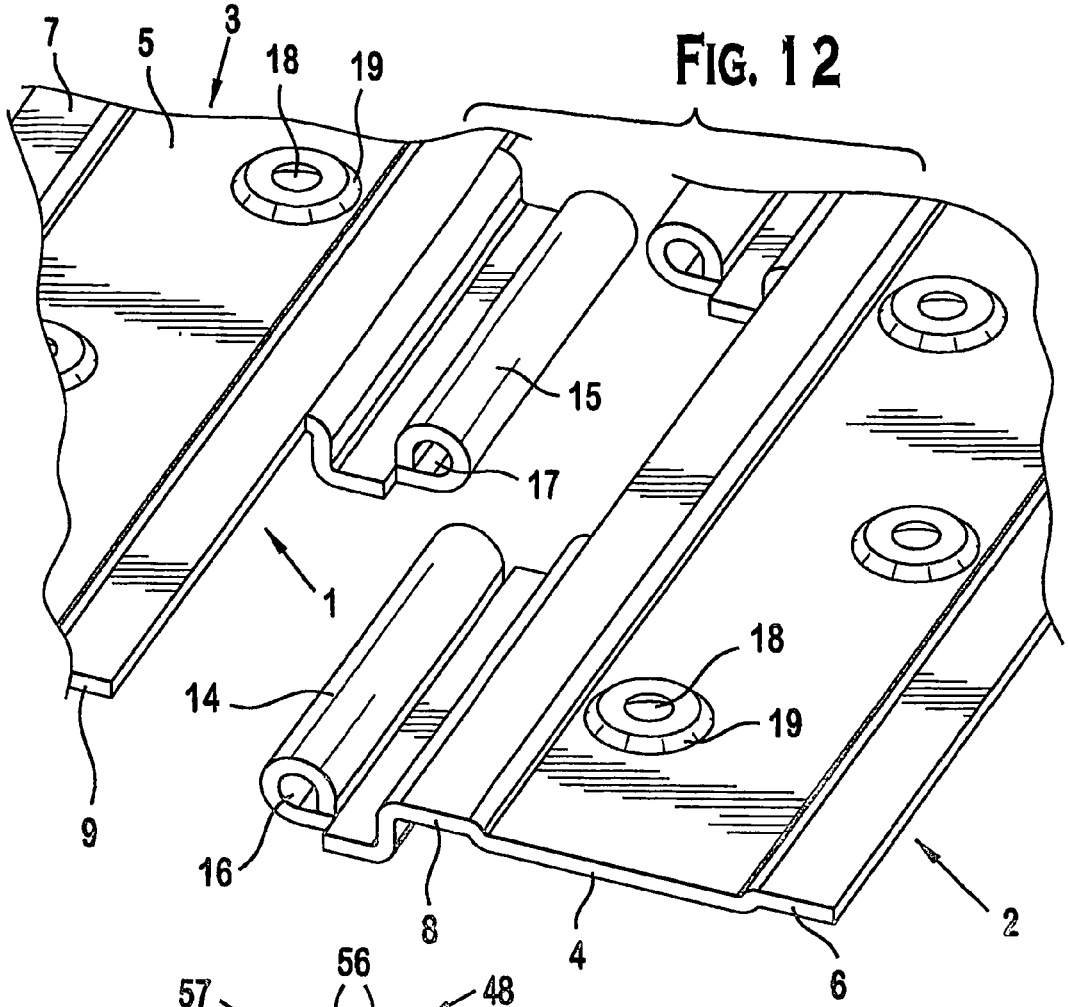
FIG. 12 is a perspective view of the continuous hinge of FIG. 10 in which the pin and knuckle cover have been removed and the bottom of the leaves are visible.

With additional reference to FIGS. 5A and 12, hole reinforcement 19 is generally a raised structure on the underside of the leaves 22, 23 having a thickness or height $H_R$ and preferably has a circular configuration in plan view. Accordingly, reinforcement 19 extends radially outwards from hole 18, as shown. As shown in FIG. 6, height $H_R$ of reinforcement 19 preferably is about the same as the depth $D_C$ of cavity 28 so that the top 106 of reinforcement 19 may simultaneously abut hinged objects 26, 27 with base portions 24, 25 respectively when hinge members 2, 3 are mounted thereto. As noted above, this strengthens the attachment of hinge members 2, 3 to hinged objects 26, 27 and prevents deformation of the leaves 22, 23 when the fasteners are tightened. Although reinforcement 19 is shown as having a circular configuration, it will be appreciated that reinforcement 19 may have other suitable configurations. Preferably, reinforcement 19 has a substantially flattened top 37 configured to rest against a hinged object for securely abutting the object when the hinge member is mounted thereto, as noted above.

Preferably, fastener hole 18 is formed by a punching operation which may use a compound punch to make the initial penetration through the leaf material and the conical hole shape in a single blow. Alternatively, separate operations may be used to make the initial penetration and shape the hole. It should be noted, however, that the hole 18 may be made in the leaf material by machining or other suitable means know in the art; however, a punching operation is typically more economical. Hole reinforcement 19 may be formed by placing a button on the bottom side of the hinge leaf during the punching operation, which in turn produces the reinforcement when hole 18 is being formed. In this case, reinforcement 19 is formed of the leaf material that is punched and deformed during the hole punching process. However, reinforcement 19 may be formed by other suitable means commonly used in the art. In addition, reinforcement 19 may be a separate component of suitable material and shape that is attached to the underside of hinge leaves by any suitable means commonly known in the art, such as by use of adhesives, welding, etc.

Figure 5B:
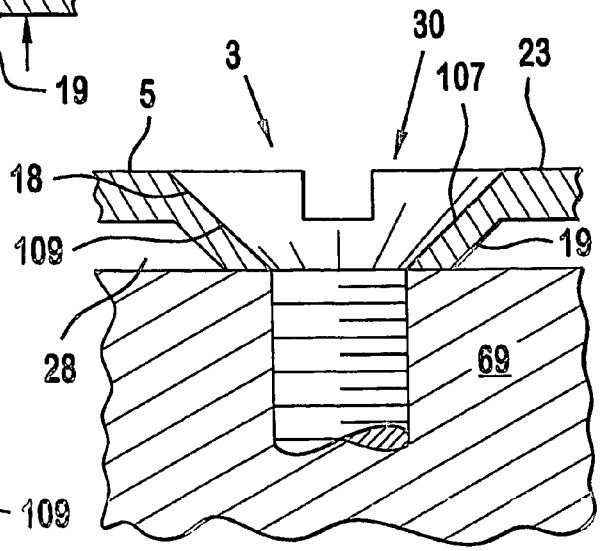
FIG. 5B is a cross-sectional view of the fastener hole of FIG. 5A in which a screw of the type depicted in FIG. 2A is shown inserted.
Figure 5C:
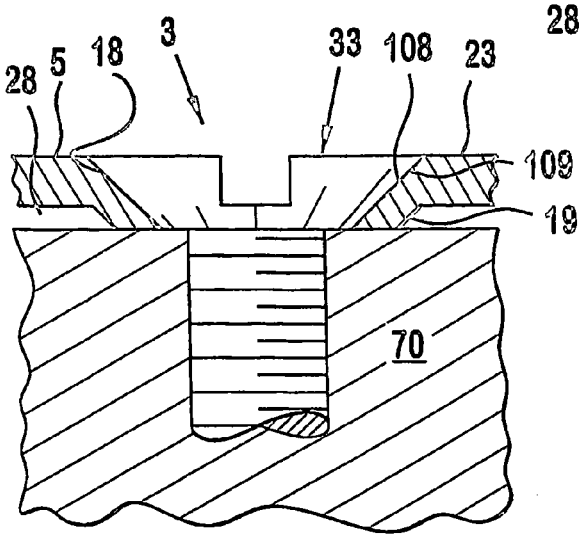
FIG. 5C is a cross-sectional view of the fastener hole of FIG. 5A in which a screw of the type depicted in FIG. 2B is shown inserted.

FIG. 5B shows a cross section through a fastener hole 18 in raised mounting portion 5 of leaf 23 of hinge member 3 with a full conical head screw 30 installed therein into a hinged object 69. Hole reinforcement 19 is abutted against a hinged object 69. Mounting portion 5 of leaf 23 and reinforcement 19 together provide a preferred embodiment of a means for supporting a majority of side surfaces 107, 108 of screws 30, 33, respectively, which prevents screw pull-through in leaf 23 when mounted to a hinged object, particularly if leaf 23 is made of thin gauge material. As shown, mounting portion 5 and reinforcement 19 together preferably supports at least 60% of the side surface 107 of head 31 of screw 30, and more preferably at least 75% of side head surface 107. Alternatively, mounting portion 5 and reinforcement 19 together preferably supports at least 60% of the depth $D_1$ of head 31 of screw 30, and more preferably at least 75% of depth $D_1$ of head 31. FIG. 5C shows a similar cross section through fastener hole 18 of hinge member 3, but with an undercut conical head screw 33 inserted therein into a hinged object 70. As shown, mounting portion 5 and reinforcement 19 together also preferably supports at least 60% of the side surface 108 of head 34 of screw 33, and more preferably at least 75% of side head surface 108. Alternatively, mounting portion 5 and reinforcement 19 together preferably supports at least 60% of the depth $D_2$ of head 34 of screw 33, and more preferably at least 75% of depth $D_2$ of head 34. As discussed herein, the type of screw head will be dictated by the total combined hinge leaf material and reinforcement thicknesses $D_T$ such that the depth of the screw head $D_1$ or $D_2$ is about the same as the depth $D_T$. Preferably, the hole reinforcements 19 and the base portion 24, 25 of the hinge leaves abut the hinged object when the hinge 1 is installed with screws or fasteners. It will be appreciated that the type of fasteners used with hinge 1 is not limited to those described above, and many other suitable types of fasteners are useable with the invention.

Although the preferred means for supporting a majority of side surfaces 107, 108 of screws 30, 33 described above is defined by mounting portion 5 of leaf 23 and reinforcement 19, any suitable structure may be used so long as the side surfaces 107, 108 are supported when at least a portion of the head 31, 34 of the applicable screw is in the cavity 28, as described further herein.

Referring again to FIGS. 4A-C, leaf 22 comprises a substantially flat base area or portion 24 and a substantially flat raised mounting area or portion 4. The raised mounting portion 4 comprises at least a part of leaf 22 and defines a substantially planar surface displaced apart and offset from, but parallel to base portion 24. Accordingly, the base portion 24 defines a first planar or level surface and raised portion 4 comprises a second planar or level surface. In the embodiment shown, raised portion 4 is configured as a plateau with a substantially flat top surface 40 that is raised above base portion 24, and portion 4 has a thickness substantially the same as the thickness $D_L$ as the rest of the leaf being formed from part of it. Leaf 24 has a width $W_L$ and raised portion 4 has a width $W_R$ as shown in FIG. 4C. Preferably, raised portion 4 has a width $W_R$ that is greater than 50% of the width of base portion width $W_L$. However, the width $W_R$ of the raised portion is not limited in this regard and may be of any suitable width being a matter of design choice. Preferably, for reasons which will become apparent as discussed below, the width $W_R$ is wide enough to at least allow the fastener hole 18 to be fully formed in the substantially flat area of raised portion 4.

In the embodiment shown, raised portion 4 is flanked on either side by narrow base portion sections 6 and 8. Accordingly, in this embodiment, base portion 24 further comprises base portion sections 6 and 8 on either side of raised portion 4. Raised portion 4 has a pair of sidewalls 10, 12 which define a transition between the flat base portion 24 and the raised portion 4 of leaf 22. In the embodiment shown, sidewalls 10, 12 are angled or sloping with respect to the base portion 24. However, the sidewalls 10, 12 may be perpendicular to base portion 24 or of any other suitable shape.

Preferably, leaf 23 has a similar configuration as leaf 22, as shown, also comprising a flat base area or portion 25, raised mounting area or portion 5 with sidewalls 11 and 13, and narrow base portion sections 7 and 9 on either side of raised portion 5. However, depending on the specific installation configuration and requirements, which are numerous, it should be noted that leaf 23 may necessarily have a different configuration than leaf 22. Accordingly, one leaf need not comprise a multi-level or -planar surface at all, and may require simply a flat-type conventional hinge leaf. Such may be the case where one of the hinge members is mounted on the face of the door (not shown), in lieu of on the door edge between the door frame and door (see, e.g.; FIGS. 7A-D). Thus it will be appreciated that numerous combinations of leaf configurations are possible and the invention is not limited to pairs of hinge leaves having an identical configuration. On such example is an interlocking leaf design a shown in FIGS. 14A-B, and described below.

Referring now to FIG. 6, the flat base portions 24, 25 are intended to abut hinged objects 26, 27 for mounting hinge members 2, 3 to the objects via fasteners. The raised mounting portions 4, 5 preferably do not contact the hinged objects 26, 27, and define cavities 28, 29 between the raised mounting portions and the flat base portions 24, 25, as shown. Cavity 28 is bounded by underside 101 of raised mounting portion 5 and its sidewalls 11, 13. Cavity 29 is bounded by underside 100 of raised mounting portion 4 and its sidewalls 10, 12. Preferably, the raised mounting portions 4, 5 and their respective cavities 28, 29 are located in at least the area of the fastener holes 18 to provide sufficient clearance for accommodating the fastener hole reinforcements 19 on the underside of the hinge leaves 22, 23. Preferably, the depth $D_C$ of the cavities 28, 29 is designed such that the flat base portions 24, 25 and hole reinforcements 19 are substantially in contact with the hinged objects 26, 27 with the hinge members 2, 3 attached thereto (recognizing that retrofit hinge applications may preclude a perfect fit along the entire length of the continuous hinge due to warpage of the hinged objects, such as doors and frames).

In the embodiment shown in FIGS. 8-12, raised leaf portions are configured to define longitudinally extending raised ribs or rails 38, 39 running along substantially the entire length of the leaves 22, 23. It should be noted that in other embodiments, the raised leaf portions need not extend continuously along the entire length of the hinge leaves 22, 23. The extent and configuration of the raised leaf portion is a matter of design choice and will be determined by the fastener hole 18 arrangement and spacing between the holes. Accordingly, although a staggered hole 18 arrangement is shown in FIGS. 8-12, for example, other arrangements of holes may be selected. Also as shown in FIGS. 8-12, for continuous full-length hinges, at least five longitudinally-spaced-apart holes 18 may preferably be disposed along the length L of the leaves 22, 23, with the optimum number of fastener holes 18 being governed by the weight of the hinged objects and fastening strength required.

As shown in FIG. 4A, $W_H$ represents the total closed width of the hinge 1 measured from outside of leaf 22 to outside of leaf 23. Preferably, $W_H$ is about 5/16 inch to allow a hinge 1 made according to the present invention to meet the industry standard door installation clearance gap. This provides great flexibility in meeting architectural specifications for new door installations and permits ready substitution and retrofit of hinge 1 for existing hinge installations.

Hinge members 2, 3 may be fabricated of any suitable material possessing sufficient strength and thickness for the intended operating conditions and service factors. Preferably, hinge members 2, 3 are made from steel sheet which is stamped, formed, and punched in a series of progressive manufacturing operations to create the leaves, knuckles, fastener holes, etc. Steel has superior material strength in contrast to aluminum which is a common material used for continuous hinges. Accordingly, a hinge 1 made according to the invention can be made of steel significantly thinner than a hinge made of aluminum. Preferably, the steel is about 0.075 inches thick. The hinge members 2, 3 may be made of stainless steel for improved corrosion resistance. The hinge members 2, 3 may also be fabricated of aluminum which is extruded, machined, relieved, and otherwise formed to produce the required hinge features.

Figure 7A:
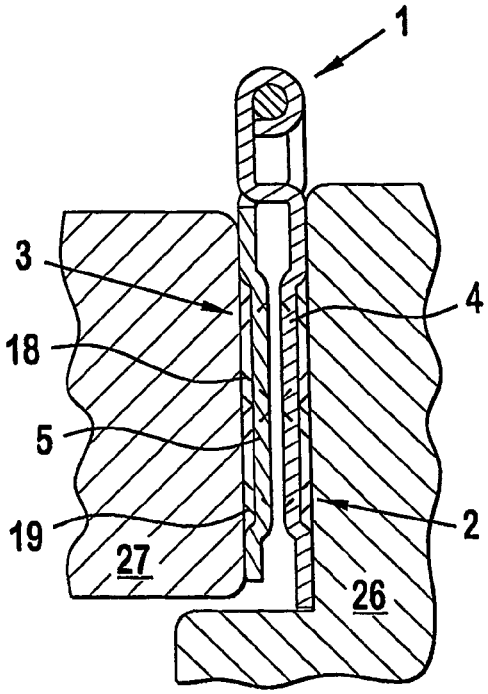
FIG. 7A is a cross-sectional view of a continuous hinge having one embodiment of a hinge leaf according to the principles of the present invention in which the hinge is installed on hinged objects.
Figure 7C:
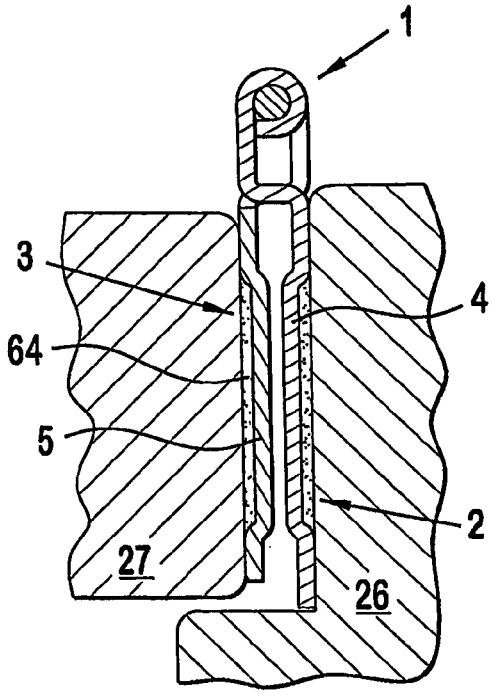
FIG. 7C is a cross-sectional view of the continuous hinge of FIG. 7A in which an intumescent material is incorporated.
Figure 7B:
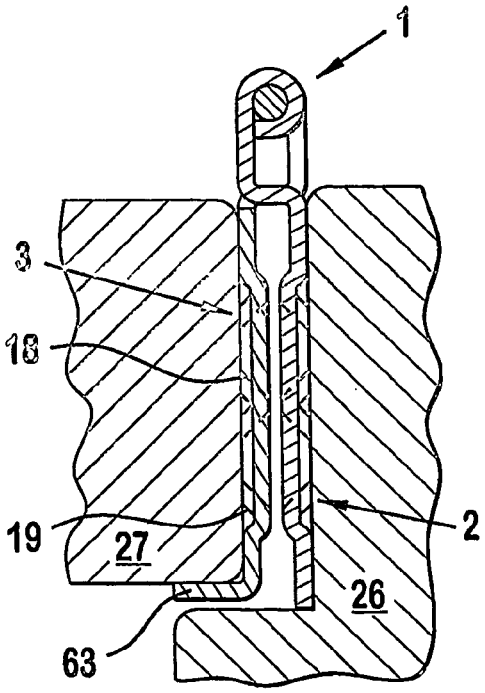
FIG. 7B is a cross-sectional view of a continuous hinge having one embodiment of a hinge leaf according to the principles of the present invention in which the hinge has a corner guard and is installed on hinged objects.
Figure 7D:
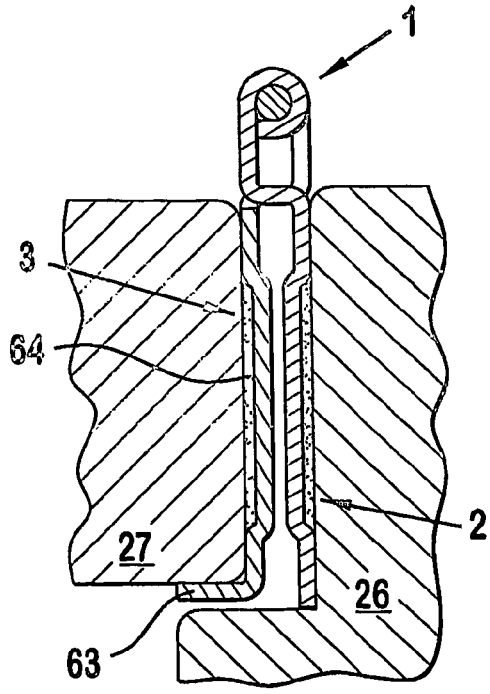
FIG. 7D is a cross-sectional view of the continuous hinge of FIG. 7B in which an intumescent material is incorporated.

FIGS. 7A-D depicts various hinge installations of the continuous hinge type generally shown FIGS. 4A-C. FIG. 7A depicts a continuous hinge 1 having hinge members 2, 3 installed on hinged objects 26, 27, respectively. Fastener holes 18 and corresponding hole reinforcements 19 are also shown. FIG. 7B is essentially the same as FIG. 7A, but hinge member 3 has a corner guard 63 as shown to protect the edge of hinged object 27.

Figure 9:
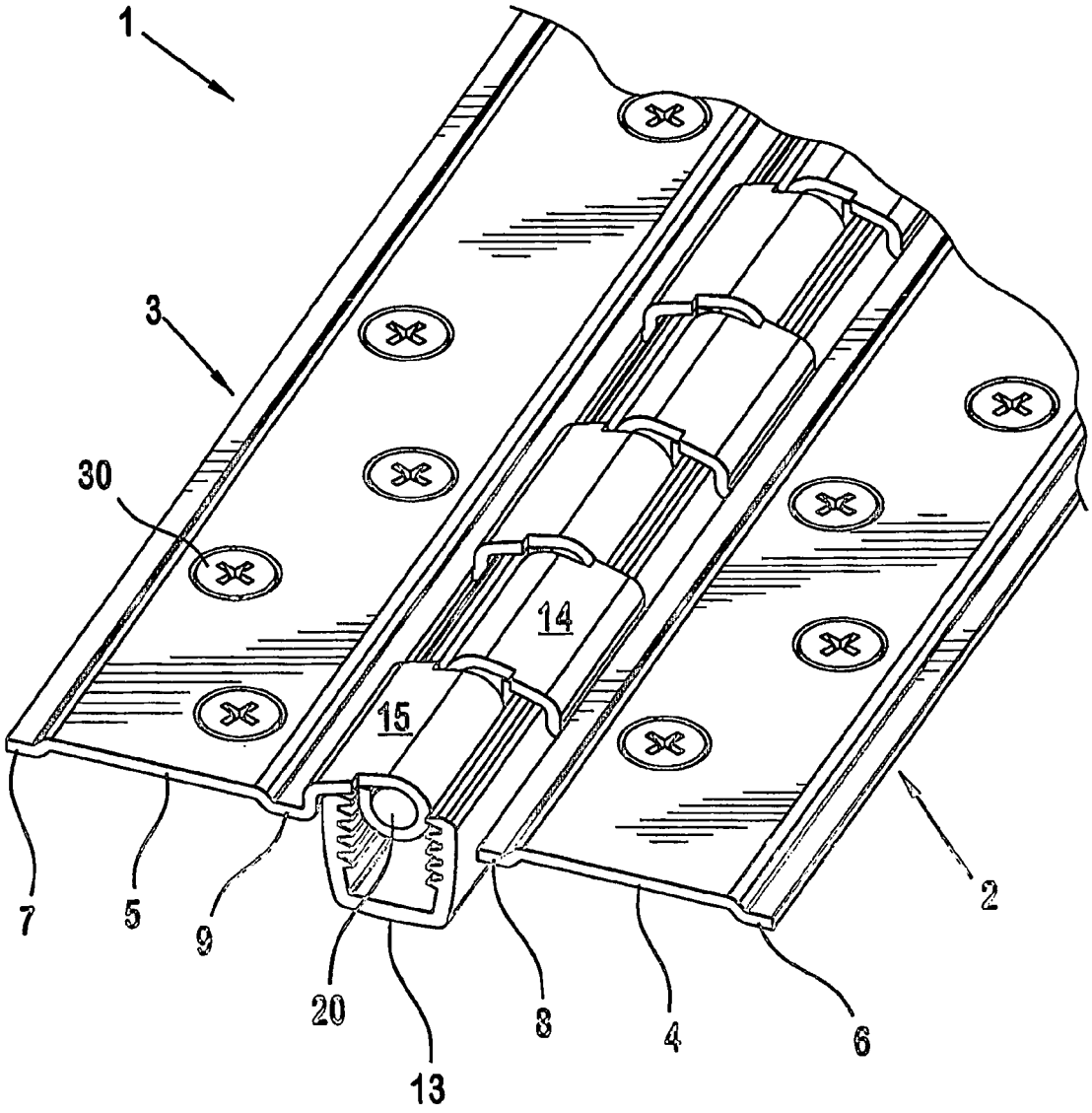
FIG. 9 is a perspective view of the continuous hinge of FIG. 8 in an open position and in which the top of the leaves are visible.
Figure 10:
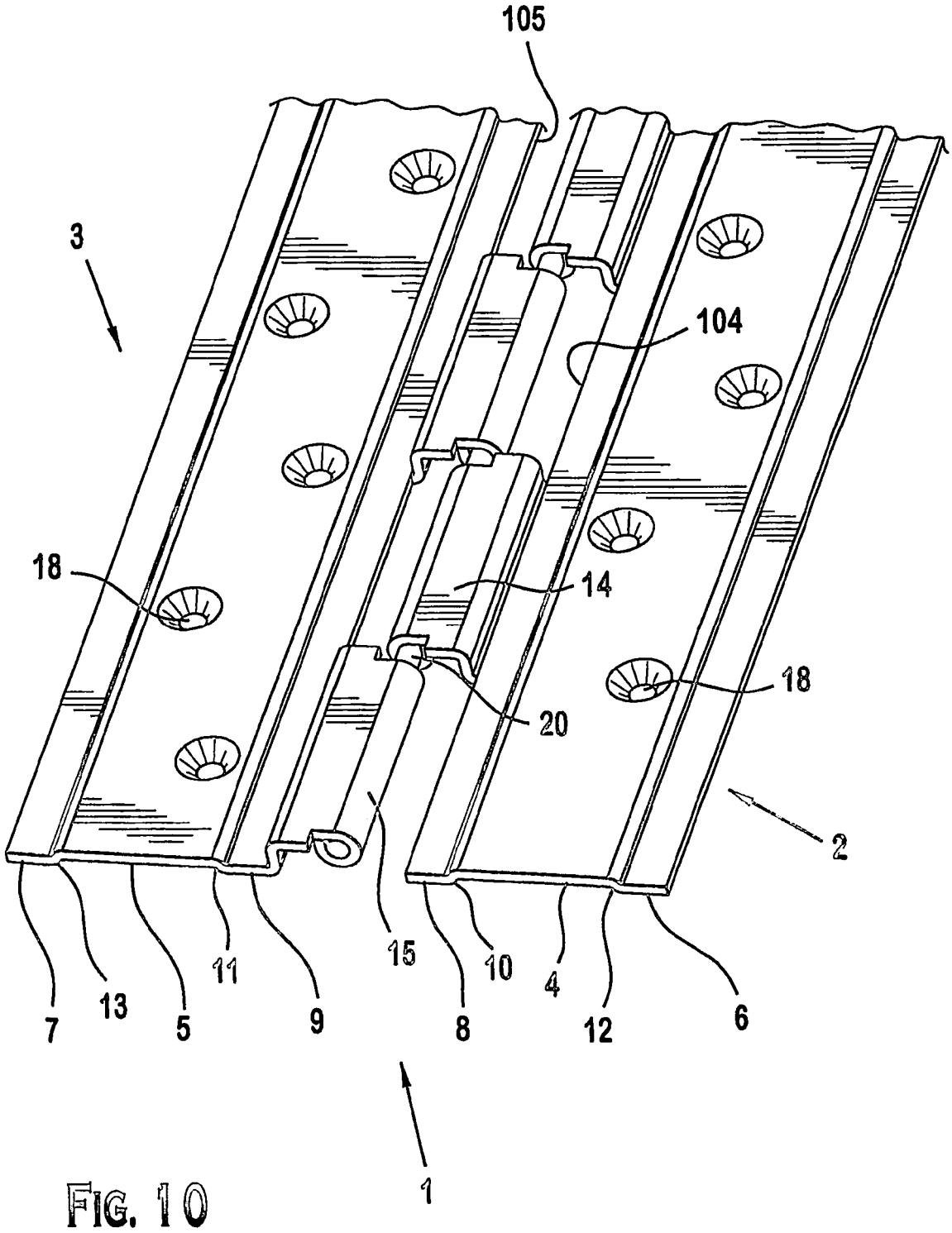
FIG. 10 is a perspective view of the continuous hinge of FIG. 9 in which the knuckle cover has been removed.
Figure 11:
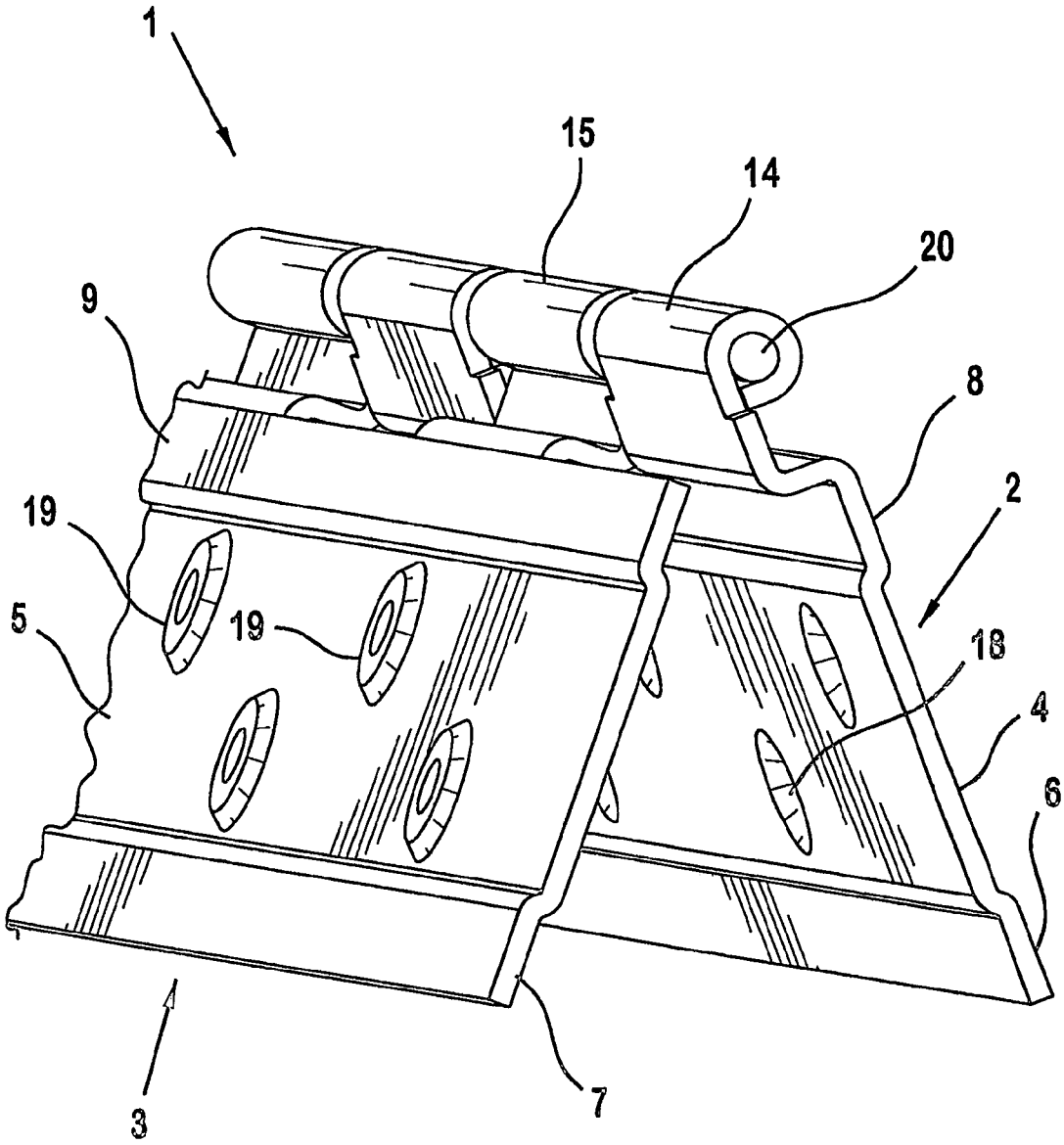
FIG. 11 is a perspective view of the continuous hinge of FIG. 10 in a partially open position.

FIGS. 7C and D show the hinges 1 of FIGS. 7A and B, respectively, but with the addition of an intumescent fire-resistant material 64. Intumescent material 64 is inserted in the recesses or cavities 28, 29 (best seen in FIG. 6) formed beneath hinge members 2, 3 in the areas of the raised leaf portions 4, 5. The combination of the hinge member recesses 28, 29 with intumescent material 64 create a superior fire resistant hinge, particularly if hinge members 2, 3 are made of steel which is more fire resistant than aluminum. Preferably, raised portions 4, 5 are configured to form longitudinally extending raised ribs or rails as shown in FIGS. 8-10 when the hinges are intended to be used in conjunction with intumescent material 64 for fire-resistance.

Figure 3A:
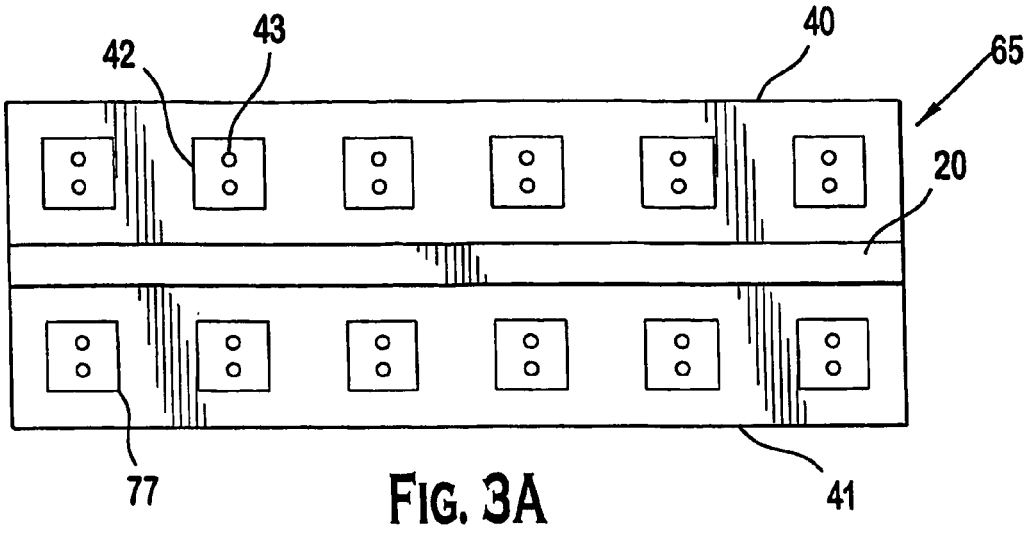
FIG. 3A is a top view of a continuous hinge having one embodiment of a hinge leaf in accordance with principles of the present invention.
Figure 3B:
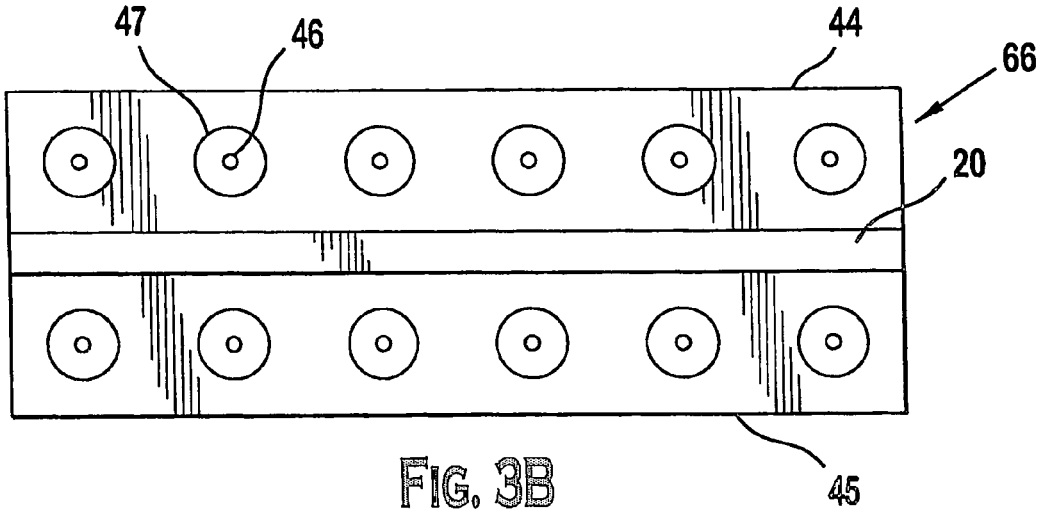
FIG. 3B is a top view of a continuous hinge having one embodiment of a hinge leaf in accordance with principles of the present invention.
Figure 3C:
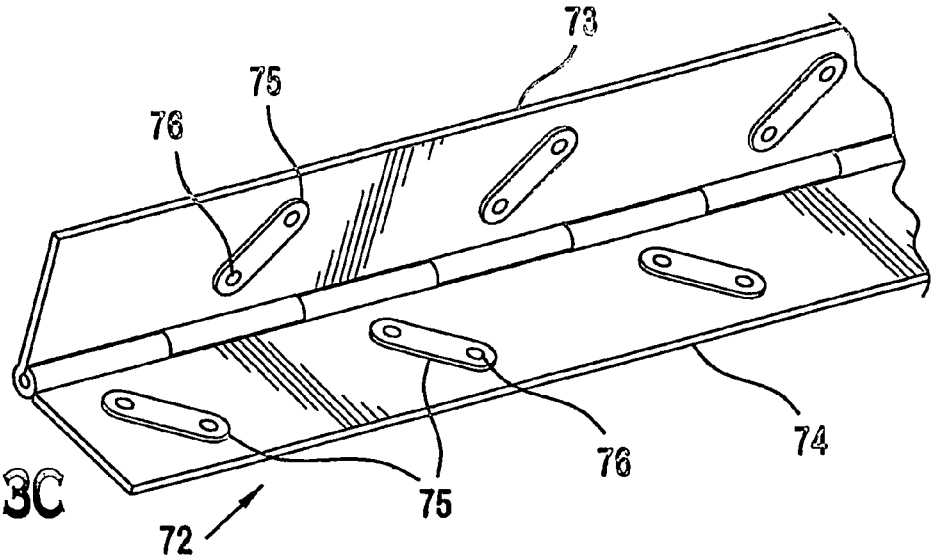
FIG. 3C is a top view of a continuous hinge having one embodiment of a hinge leaf according to principles of the present invention.

FIGS. 8-12 provide various perspective views of a partial length of the continuous hinge 1 shown in FIGS. 4A-C, and described in detail above, as continuous hinges may extend for substantially the entire length of the joined portion of a hinged object. As shown in FIGS. 8-12, the raised leaf portions 4, 5 form longitudinally extending raised ribs or rails which extend from one end of leaves 22, 23 to the opposite end. It will be appreciated that the raised ribs or rail need not extend for the entire length of the hinge leaves 22, 23 as shown, and may have an interrupted or intermittent pattern comprising a plurality of raised portions, as shown for example in one embodiment in FIG. 3A. In that embodiment, leaves 40, 41 have substantially square or rectangular shaped raised portions 42 with fastener holes 43 located within the raised portion. Fastener holes 43 are arranged in pairs oriented across the transverse axis TA of continuous hinge 65. Optionally, the corners of raised portions 42 may have a rounded chamfer 77 (as shown for the lower left raised portion) to eliminate sharp corners and reduce the possibility of tearing the leaf material in the stamping or embossing fabrication step. An alternate embodiment of a hinge 66 formed according to the principles of the present invention is shown in FIG. 3B wherein leaves 44, 45 have circular shaped raised portions 47 surrounding fastener holes 46. Yet another embodiment is shown in FIG. 3C of a hinge 72 having leaves 73, 74 with interrupted raised portions 75 that are oblong in shape and disposed at an angle with respect to the longitudinal axis of the hinge. In this embodiment, the raised portions 75 each encompass a pair of transversely staggered fastener holes 76. The raised portions 75 on leaf 73 may be longitudinally staggered in position on the leaf in relation to the raised portions 75 on opposing leaf 74, such that the raised portions 75 of one leaf are interspersed with those of the opposing leaf when the hinge is in a closed position. Use of an interspersed raised portion pattern as shown in FIG. 3C allows the closed width $W_H$ (see FIG. 4A) of hinge 72 to be minimized for installation where small door-to-door or door-to-frame clearance gaps are required. Accordingly, based on the foregoing examples, it will be apparent that the invention is not limited to any particular shape, number, or size of the raised portions. Preferably, however, fastener holes which are intended to receive screws should be located within the raised leaf portions to accommodate a hole reinforcement (as described herein) beneath the fastener holes.

Figure 13:
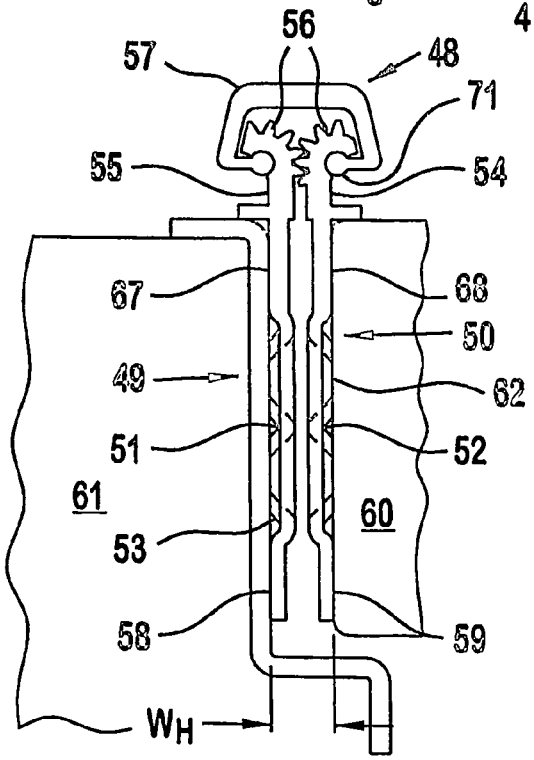
FIG. 13 is a cross-sectional view of a continuous hinge having one embodiment of a hinge leaf according to the principles of the present invention in which the hinge is in a closed position.

Referring to FIG. 13, there is shown a continuous hinge 48 according to the invention wherein the longitudinally extending hinge members 49, 50 have leaves 67, 68 that are pivotably connected along at least a part of their respective longitudinally extending edges 54, 55 to each other. Preferably, the edges 54, 55 each have cooperating geared segments 56 that are operably held in a coupled relationship by a longitudinally extending joining member such as clamp 57. Preferably, clamp 57 is roughly channel shaped in cross section and has two inwardly inclined longitudinally extending edges 71 that operably engage hinge edges 54, 55, as shown. This type of continuous hinge is more fully shown and described in U.S. Pat. No. 3,402,422 noted above, which is incorporated herein by reference. Hinge members 49, 50 comprise leaves 67, 68 having base portions 58, 59 (for direct contact with hinged objects 60, 61) and raised portions 51, 52. Fastener holes 62 with corresponding hole reinforcements 53 are preferably situated in the raised portions 51, 52. In one embodiment, the closed width of the hinge 48 is preferably about 5/16 inch.

FIG. 14A-B shows a continuous hinge formed accordingly to principles of the present invention with an interlocking raised rib design to provide an improved air seal and impact resistance. Hinge 77 comprises a hinge members 78, 79 having leaves 80, 81, respectively. Leaves 80, 81 have respective knuckles 88, 89 which in this embodiment, are pivotably connected by a pin 90.

Leaf 80 (the underside of which is shown in FIG. 14A) includes a longitudinally extending raised rail or rib 84 and a base portion 85 for abutting directly against a hinged object 92 (a door, for example) as shown in FIG. 14B. Located on the raised rib 84 are a plurality of fastener holes 86 with associated hole reinforcements 87. Preferably, the height of reinforcements 87 is such that the reinforcements and base portion 85 abut hinged object 92 when the hinge member 78 is installed with fasteners 93 (shown in FIG. 14B).

Leaf 81 (the topside of which is shown in FIG. 14A) includes a pair of longitudinally extending and spaced apart raised ribs 82 and a base portion 83 for abutting a hinge object 91 (a door frame or jamb, for example) as shown in FIG. 14B. A plurality of fastener holes 86 with associated reinforcements 19 (not visible in FIG. 14A) are provided in raised ribs 82. The transverse location of raised ribs 82 are cooperatively selected with the transverse location of raised rib 84 of leaf 80 such that raised rib 84 falls between raised ribs 82 as shown in FIG. 14B. This arrangement improves resistance against air infiltration through the hinge 77. Hinge 77 impact resistance is also be improved because raised ribs 82 and 84 form an interlocking pattern wherein the ribs contact each other to resist transverse displacement against an impact force 'T' (see FIG. 14B) acting in the direction shown on hinged object 92. Such would be the case if someone were to attempt a forced entry by kicking or otherwise thrusting against a door. Thus, the interlocking raised rib design offers superior security advantages.

It will be appreciated that a continuous hinge formed according to principles of the present inventions may be used in a variety of applications where one object is intended to be pivotably mounted to another object. The invention will be particular advantageous for, but is not limited to, commercial and industrial door installations where the use of continuous hinges offers many advantages. Such installations may include door-to-frame and door-to-door mounts. Moreover, the present inventions may be used where more than two doors are to be pivotably connected together. Accordingly, the uses and applications of the present invention are not limited to those embodiments shown herein.

While the foregoing description and drawings represent the preferred embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims, and not limited to the foregoing description.

What is claimed is:

1. A pinned continuous hinge mountable along substantially the entire length of a hinged object, the hinge comprising:

a first hinge member including at least one first knuckle and a first longitudinally-extending leaf connected thereto, the first leaf including a pair of parallel spaced-apart longitudinally-extending base portions and a longitudinally-extending substantially flat mounting portion disposed therebetween, the mounting portion offset and parallel to the base portions, the mounting portion defining a longitudinally-extending cavity between the base portions, a first plurality of holes defined by the mounting portion and spaced along a first longitudinal axis, a second plurality of holes defined by the mounting portion and spaced along a second longitudinal axis, at least one each of the first and the second plurality of holes having an annular reinforcement disposed proximate to the hole in the cavity and extending outwards from the mounting portion, the mounting portion and reinforcement further defining a conical surface extending through the mounting portion and reinforcement around the periphery of the hole;

a second hinge member including at least one second knuckle and a second longitudinally extending leaf connected thereto; the second leaf including a pair of parallel spaced-apart longitudinally-extending base portions and a longitudinally-extending substantially flat mounting portion disposed therebetween, the mounting portion offset and parallel to the base portions, the mounting portion defining a longitudinally-extending cavity between the base portions, a third plurality of holes defined by the mounting portion and spaced along a third longitudinal axis, a fourth plurality of holes defined by the mounting portion and spaced along a fourth longitudinal axis, at least one each of the third and the fourth plurality of holes having an annular reinforcement disposed proximate to the hole in the cavity and extending outwards from the mounting portion, the mounting portion and reinforcement further defining a conical surface extending through the mounting portion and reinforcement around the periphery of the hole; and a pin received through the first and second knuckles to pivotably connect the first and second hinge members.

2. The hinge of claim 1, wherein the first and second hinge members have a total width measured from outside of the first leaf to the outside of second leaf of about 5/16 inches when the hinge is in a closed position with both mounting portions facing and substantially parallel to each other.

3. A continuous hinge mountable along substantially the entire length of a hinged object, the hinge comprising:

at least one first longitudinally-extending leaf having a length and including a base portion having a substantially flat first surface and a second surface with a thickness defined therebetween, and at least one mounting portion having a first substantially flat top surface and a second surface with a thickness defined therebetween, the first mounting portion surface offset and parallel to the first base portion surface;

at least one hole defined by the mounting portion between the first surface and the second surface, the hole having a conical surface; and an annular reinforcement disposed on the second surface of the mounting portion proximate to the hole, the reinforcement disposed in a longitudinally-extending cavity defined by the mounting portion and base portions, the reinforcement extending outwards from the second surface.

4. The hinge of claim 3, wherein the thickness of the mounting portion is about the same as the thickness of the base portion.

5. The hinge of claim 3, wherein the cavity below the mounting portion contains an intumescent fire-resistant material.

6. The hinge of claim 3, wherein the mounting portion is configured as a longitudinally-extending rail extending along substantially the entire length of the leaf.

7. The hinge of claim 3, wherein the leaf further comprises a plurality of mounting portions spaced intermittently along the length of the leaf.

8. The hinge of claim 7, wherein the plurality of mounting portions are elongated and oriented angularly with respect to an edge extending longitudinally along the length of the leaf.

9. The hinge of claim 3, wherein the leaf defines at least five longitudinally-spaced-apart conical holes disposed along the length of the leaf.

10. The hinge of claim 3, further comprising: a second longitudinally-extending leaf pivotally connected to the first leaf, the second leaf having a length and including a base portion having a surface and a thickness, and at least one mounting portion having a first surface and a second surface with a thickness defined therebetween, the first mounting portion surface offset and parallel to the base portion surface; and at least one hole defined by the mounting portion of the second leaf between the first surface and the second surface, the hole having a conical surface.

11. The hinge of claim 3, wherein the leaf is made of steel.

12. The hinge of claim 3, wherein the annular reinforcement disposed in the cavity is work-hardened.

13. The hinge of claim 12, wherein the annular reinforcement extends outwards to a plane defined by the base portion surface, the base portion and reinforcement contacting the hinged object when the hinge leaf is mounted thereto.

14. A continuous hinge mountable along substantially the entire length of a hinged object, the hinge comprising:

at least one first longitudinally-extending leaf mountable to a hinged object, the leaf having a length and including a first and a second base portion each having a substantially flat first surface and a second surface with a thickness defined therebetween, and at least one mounting portion having a thickness defined between a substantially flat first surface and a second surface, the first mounting portion surface offset and parallel to the base portion surfaces;

at least one hole defined by the mounting portion between the first surface and the second surface, the hole having a conical surface; and an annular reinforcement disposed on the second surface of the mounting portion proximate to the hole, the reinforcement disposed in a longitudinally-extending cavity defined by the mounting portion and base portions, the reinforcement extending outwards from the second surface;

wherein the cavity extends along the entire length of the first leaf.

15. The hinge of claim 14, wherein the conical hole surface extends into the annular reinforcement.

16. The hinge of claim 15, wherein the conical surface has a depth sufficient to fully receive and support a majority of a side surface of a conical head of a flat head mounting screw, whereby the top of the screw maybe installed substantially flush with the top of the first surface of the mounting portion when the leaf is mounted to the hinged object.

17. The hinge of claim 14, wherein the annular reinforcement has a flattened top for abutting the hinged object when the leaf is mounted thereto.

18. The hinge of claim 17, wherein the annular reinforcement is work hardened.

19. The hinge of claim 14, wherein the combined thickness through the mounting portion and the reinforcement is greater than the thickness of the mounting portion.

20. The hinge of claim 14, wherein the mounting portion is configured as a raised longitudinally-extending rail extending along substantially the length of the leaf.

21. The hinge of claim 20, wherein the base portion further comprises a width and the mounting portion further comprises a width, the width of the mounting portion greater than 50% of the width of base portion.

22. The hinge of claim 14, further comprising a first plurality of holes with reinforcements spaced along a first longitudinal axis of the leaf.

23. The hinge of claim 22, further comprising a second plurality of holes with reinforcements spaced along a second longitudinal axis of the leaf spaced apart from the first longitudinal axis.

24. The hinge of claim 14, further comprising:

a second longitudinally-extending leaf pivotally connected to the first leaf and mountable to a hinged object, the second leaf having a length and including a base portion having a substantially flat surface and a thickness, and at least one mounting portion having a thickness defined between a substantially flat first surface and a second surface, the first mounting portion surface offset and parallel to the base portion surface;

at least one hole defined by the mounting portion of the second leaf between the first surface and the second surface, the hole having a conical surface; and an annular reinforcement disposed on the second surface of the mounting portion of the second leaf proximate to the hole, the reinforcement extending outwards from the second surface.

25. A continuous hinge mountable along substantially the entire length of a hinged object, the hinge comprising:

a first longitudinally-extending leaf having a length, the first leaf including a substantially flat longitudinally-extending base portion and at least one substantially flat longitudinally-extending mounting portion offset and parallel to the base portion to define a longitudinally-extending cavity between the mounting portion and the base portion, the mounting portion extending along the entire length of the first leaf;

a longitudinally-extending joining member pivotably connected to the first longitudinally-extending leaf;

a second longitudinally-extending leaf pivotably connected to the longitudinally-extending joining member; and a plurality of work-hardened annular reinforcements formed in the cavity and each reinforcement defining a conical mounting hole for receiving a fastener for mounting the first leaf to the hinged object.

26. The hinge of claim 25, wherein the depth of the conical surface is from about 0.078 inches to about 0.092 inches.

27. The hinge of claim 25, wherein the first and second leaves each further comprise at least one knuckle, and wherein the joining member is a longitudinally-extending pin received in the knuckles to pivotably connect the first and second leaves.

28. The hinge of claim 25, wherein the first and second leaves each further comprise a longitudinally-extending edge, and wherein the joining member is a longitudinally-extending clamp pivotably engaging the longitudinally-extending edges of the first and second leaves.

29. A continuous hinge mountable along substantially the entire length of a hinged object, the hinge comprising:

at least one longitudinally-extending leaf having a length and including a longitudinally-extending base portion having an underside and a thickness, and at least one longitudinally-extending substantially flat raised mounting portion having an underside and a thickness, the underside of the mounting portion offset and parallel to the underside of the base portion to define a longitudinally-extending cavity having a depth;

at least one hole disposed in the raised mounting portion to attach the leaf to the hinged object, the hole having a conical surface; and a work-hardened reinforcing ring having a thickness disposed on the underside of the raised mounting portion around the hole, the ring extending into the cavity radially outwards from the hole and perpendicular to the underside of the mounting portion, wherein a combined thickness through the raised mounting portion and ring is greater than the thickness of the raised portion.

30. The hinge of claim 29, wherein the combined thickness through the mounting portion and ring is greater than the thickness of the raised mounting portion.

31. The hinge of claim 29, wherein the ring has a flattened top, the flattened top aligned substantially parallel with the underside of the base portion, whereby the flattened top and the base portion simultaneously abut the hinged object when the leaf is placed against the hinged object in a mounting position.

32. The hinge of claim 29, wherein the ring is formed as an integral part of the mounting portion.

33. The hinge of claim 29, wherein the depth of the cavity is about the same as the thickness of the reinforcing ring.

* * * * *